US007581820B2

(12) United States Patent
Kwon et al.

(10) Patent No.: US 7,581,820 B2
(45) Date of Patent: Sep. 1, 2009

(54) INKJET PRINTHEAD AND IMAGE FORMING APPARATUS INCLUDING THE SAME

(75) Inventors: Myong-jong Kwon, Suwon-si (KR); Young-ung Ha, Suwon-si (KR); Sung-joon Park, Suwon-si (KR); Kyong-il Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 413 days.

(21) Appl. No.: 11/567,877

(22) Filed: Dec. 7, 2006

(65) Prior Publication Data

US 2008/0012906 A1 Jan. 17, 2008

(30) Foreign Application Priority Data

Jul. 11, 2006 (KR) ..... 10-2006-0064858

(51) Int. Cl.
*B41J 2/05* (2006.01)

(52) U.S. Cl. ..... 347/56; 347/62

(58) Field of Classification Search ..... 347/20, 347/56–59, 61–65, 67

See application file for complete search history.

(56) References Cited

U.S. PATENT DOCUMENTS

| | | | | |
|---|---|---|---|---|
| 2,279,763 | A | 4/1942 | Sivil | |
| 4,155,660 | A | 5/1979 | Takahashi et al. | |
| 5,992,980 | A * | 11/1999 | Hasegawa et al. | 347/62 |
| 6,637,866 | B1 * | 10/2003 | Cornell et al. | 347/64 |

FOREIGN PATENT DOCUMENTS

| | | | | |
|---|---|---|---|---|
| EP | 0855271 | | 7/1998 | |
| JP | 401087271 | A * | 9/1987 | 347/150 |

OTHER PUBLICATIONS

European Search Report dated Oct. 17, 2007 issued in EP 07101165.4.

* cited by examiner

*Primary Examiner*—Juanita D Stephens
(74) *Attorney, Agent, or Firm*—Stanzione & Kim LLP

(57) ABSTRACT

Thermal inkjet printheads and an inkjet image forming apparatus including the thermal inkjet printheads. Each of the thermal inkjet printheads includes a heater that heats ink by directly contacting the ink and is formed of an alloy of Pt—Ru or an alloy of Pt—Ir—X, where X is at least a material selected from the group consisting of Ta, W, Cr, Al, and O.

28 Claims, 8 Drawing Sheets

INKJET PRINTHEAD AND IMAGE FORMING APPARATUS INCLUDING THE SAME

CROSS-REFERENCE TO RELATED APPLICATIONS

This application claims priority under 35 U.S.C. §119(a) Korean Patent Application No. 10-2006-0064858, filed on Jul. 11, 2006, in the Korean Intellectual Property Office, the disclosure of which is incorporated herein in its entirety by reference.

BACKGROUND OF THE INVENTION

1. Field of the Invention

The present general inventive concept relates to a inkjet printhead and an inkjet image forming apparatus including the inkjet printhead, and more particularly, to a thermally driven inkjet printhead having a heater that allows the inkjet printhead to be driven at a low power and that can increase a lifespan and stability of the inkjet printhead, and an inkjet image forming apparatus including the inkjet printhead.

2. Description of the Related Art

In general, inkjet image forming apparatuses are devices such as printers for printing images having a predetermined color by ejecting a small volume of ink droplets from an inkjet printhead on a desired position of a printing medium. Inkjet image forming apparatuses can be classified into shuttle type inkjet image forming apparatuses, in which a printhead prints an image by traveling in a same direction (hereinafter a secondary ejection direction) and in a perpendicular direction (hereinafter, a primary ejection direction) to the moving direction of a printing medium, and line printing type inkjet image forming apparatuses which have recently been developed for high-speed printing and have an array type inkjet printhead.

The line printing type inkjet image forming apparatus includes one or multiple array type inkjet printheads to dispose a plurality of nozzles to correspond to at least a width of a printing medium. Printing is performed in a state that the inkjet printheads are fixed while the printing medium moves in the secondary ejection direction, thereby enabling high-speed printing.

The inkjet printheads can be classified into two types according to the mechanism by which ink droplets are ejected. A first type is a thermal inkjet printhead that ejects ink droplets by an expansion force of ink bubbles generated in the ink using a heat source, and the second type is a piezoelectric inkjet printhead that uses a piezoelectric element and ejects ink droplets by a pressure applied to the ink due to a deformation of the piezoelectric element.

The mechanism of ejecting ink droplets in the thermal inkjet printhead will now be described in more detail. When a pulse type power is applied to a heater formed of an electrical heating material, the heater is instantaneously heated to approximately 500° C., and ink adjacent to the heater is instantaneously heated to approximately 300° C. Accordingly, the ink boils, and thus, bubbles are generated in the ink. The bubbles expand and apply a pressure to the ink filled in an ink chamber. As a result, the ink around nozzles is ejected to the outside of the ink chamber in the form of droplets through the nozzles.

The thermal inkjet printhead can be further classified into a top-shooting type, a side-shooting type, and a back-shooting type thermal inkjet printhead according to directions of bubbles growing and ink droplet ejection. In a top-shooting type inkjet printhead, bubbles grow in a direction in which ink droplets are ejected. In a side-shooting type inkjet printhead, bubbles grow in a direction perpendicular to the direction in which ink droplets are ejected. In a back-shooting type inkjet printhead, bubbles grow in a direction opposite to the direction ink droplets are ejected.

FIG. 1 illustrates a lateral cross-sectional view of a conventional inkjet printhead. Referring to FIG. 1, the conventional inkjet printhead includes a substrate 11, a chamber layer 20 which is stacked on the substrate 11 and includes an ink chamber 22 in which ink is filled, and a nozzle layer 30 which is stacked on the chamber layer 20 and includes a nozzle 32 through which the ink is ejected. A heater 13 for generating bubbles by heating ink is formed below the ink chamber 22.

An insulating layer 12 for thermally and electrically insulating the heater 13 from the substrate 11 is formed on the substrate 11. The heater 13 can be formed by patterning a thin film deposited on the insulating layer 12 using a material such as TaAl, TaN, $HfB_2$, etc. An electrode 14 for applying power to the heater 13 is formed on the heater 13, and can be formed of a conductive metal such as aluminum.

A passivation layer 15 for protecting the heater 13 and the electrode 14 is formed on surfaces of the heater 13 and the electrode 14. The passivation layer 15 prevents chemical and mechanical corrosion of the heater 13 and the electrode 14 by blocking the heater 13 and the electrode 14 from direct contacting ink, and can be formed of a silicon nitride $SiN_x$ having a low thermal conductivity.

An anti-cavitation layer 16 is formed on the passivation layer 15. The anti-cavitation layer 16 protects the heater 13 and the electrode 14 from a cavitation force generated when the bubbles disappear, and can be mainly formed of Ta.

Recently, due to a high integration and a high-speed operation of inkjet printheads, inkjet printheads that can be operated at a low power are required. Low power operation is particularly required in an array type inkjet printhead that has a plurality of nozzles and operates at a high frequency. To realize a low power operation of an inkjet printhead, a high efficiency of the heater 13 is essential.

The heater 13 must be able to instantaneously increase the temperature of ink to more than 300° C. in order to generate bubbles in the ink. However, a conventional inkjet printhead has a structure in which the heater 13 is shielded from ink by layers having a predetermined thickness, such as the passivation layer 15 and the anti-cavitation layer 16. Therefore, to transmit a heat to the ink, an electric energy to be applied to the heater 13 must be increased.

In particular, in an array type inkjet printhead, a large amount of electric energy for driving the heaters is instantaneously consumed since a few tens of thousands of heaters corresponding to the number of nozzles of the array type inkjet printhead are operated at a high frequency for high-speed printing. The inefficiency of the heaters can affect a design limit of circuits and elements, an integration density of the nozzles, or can be a safety issue of a line printing type inkjet image forming apparatus. Also, heat can be accumulated in the inkjet printhead resulting in degradations in physical and chemical properties of the ink, for example, a viscosity, thereby reducing printing quality.

If the passivation layer 15 and the anti-cavitation layer 16 that shield the heater 13 from ink are removed, energy consumption can be reduced, and accordingly, the efficiency of the heater 13 can be increased. However, if the heater 13 formed of TaAl, TaN, or $HfB_2$ directly contacts ink, the heater 13 can be corroded through a reaction with moisture of the ink, which can greatly change the resistance of the heater 13, thereby causing electrical and chemical safety problems with the heater 13. Also, the heater 13 can be damaged by a cavitation force generated when the bubbles disappear, thereby causing a mechanical safety problem.

Therefore, there is a need to develop an inkjet printhead that has no electrical, chemical, and mechanical problems when the heater 13 directly contacts the ink, without the requirement for the passivation layer 15 and the anti-cavitation layer 16.

SUMMARY OF THE INVENTION

The present general inventive concept provides an inkjet printhead having a heater formed of a new material that can reduce energy required to eject ink and can increase electrical, chemical, and mechanical safety and lifespan, and an inkjet image forming apparatus including the inkjet printhead.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept are achieved by providing an inkjet printhead including a substrate, a heater formed on the substrate, an electrode formed on the heater to apply current to the heater, a chamber layer which is stacked on an upper part of the substrate on which the heater and the electrode are formed and includes an ink chamber which stores an ink to be ejected and is formed above a heat generation part of the heater, and a nozzle layer which is stacked on an upper part of the chamber layer and includes a plurality of nozzles through which the ink is ejected, wherein the heat generation part directly contacts the ink in the ink chamber and the heater is formed of an alloy of Pt—Ru.

The electrode may be formed on upper side surfaces of the heater.

The foregoing and/or other aspects and utilities of the present general inventive concept are also achieved by providing an inkjet printhead including a substrate, a heater formed on the substrate, an electrode formed on the heater to apply current to the heater, a chamber layer which is stacked on an upper part of the substrate on which the heater and the electrode are formed and includes an ink chamber which stores an ink to be ejected and is formed above a heat generation part of the heater, and a nozzle layer which is stacked on an upper part of the chamber layer and includes a plurality of nozzles through which the ink is ejected, wherein the heat generation part directly contacts the ink in the ink chamber and the heater is formed of an alloy of Pt, Ir, and a material X.

The material X may be an impurity.

The foregoing and/or other aspects and utilities of the present general inventive concept are also achieved by providing an inkjet image forming apparatus including thermal inkjet printheads that eject ink through a plurality of nozzles by heating a heater, wherein the heater contacts the ink and is formed of an alloy of Pt—Ru.

The foregoing and/or other aspects and utilities of the present general inventive concept are also achieved by providing an inkjet image forming apparatus comprising thermal inkjet printheads that eject ink through a plurality of nozzles by heating a heater, wherein the heater contacts the ink and is formed of an alloy of Pt—Ir and an impurity X.

The impurity X may be at least a material selected from the group consisting of Ta, W, Cr, Al, and O.

The foregoing and/or other aspects and utilities of the present general inventive concept are also achieved by providing an inkjet image forming apparatus including a plurality of thermal inkjet printheads that eject ink through a plurality of nozzles by applying a heat to the ink with a plurality of heaters, wherein the heater directly contacts the ink and is formed of one of an alloy of Pt—Ru and an alloy of Pt—Ir and an impurity X.

The heater may be made of an alloy of Pt and Ru.

The impurity X may be Ta, the heater may be made of an alloy of Pt, Ir, and Ta, and the composition percentage of Ta with respect to the sum of compositions of Pt, Ir, and Ta may be greater than about 0% and smaller than about 30%.

The impurity X maybe O, the heater may be made of an alloy of Pt, Ir, and O, and the composition percentage of O with respect to the sum of compositions of Pt, Ir, and O may be greater than about 0% and smaller than about 40%.

The heater may be made of an alloy of Pt, Ir, and the impurity X, and the impurity X may be a material selected from the group consisting of Ta, W, Cr, Al, and O, or a combination thereof.

The foregoing and/or other aspects and utilities of the present general inventive concept are also achieved by providing a thermal inkjet printhead, including a substrate, a heater formed above the substrate and including an alloy of one of Pt—Ru and Pt—Ir and an impurity X, an electrode formed above portions of the heater to expose a heat generating portion of the heater, and an ink chamber, formed above the electrode and the heater to contain ink therein such that the contained ink contacts the heater generating portion of the heater.

When the heater is made of an alloy of Pt, Ir, and the impurity X, the impurity X may be a material selected from the group consisting of Ta, W, Cr, Al, and O, or a combination thereof.

The foregoing and/or other aspects and utilities of the present general inventive concept are also achieved by providing a heating element usable in an inkjet printhead, the heating element comprising an alloy of one of Pt—Ru and PT-Ir and an impurity X.

When the alloy is made of Pt, Ir, and the impurity X, and the impurity X may be a material selected from the group consisting of Ta, W, Cr, Al, and O, or a combination thereof.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
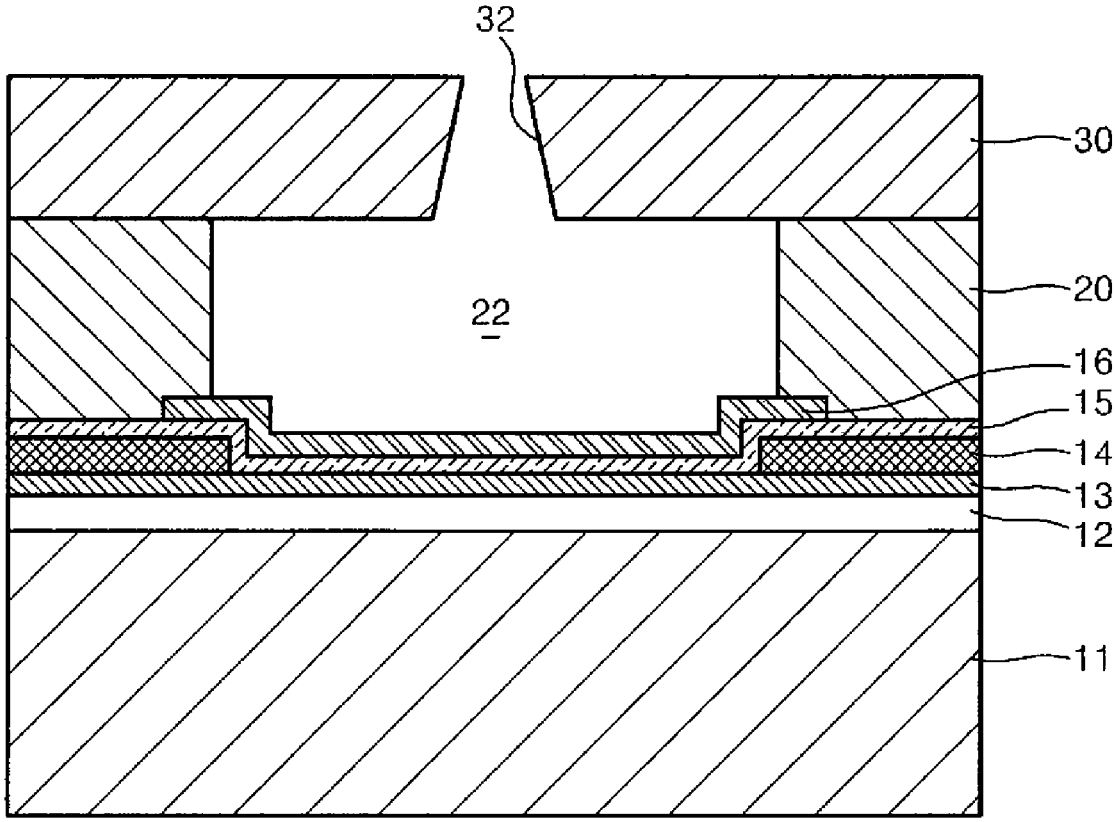
FIG. 1 (PRIOR ART)
FIG. 1 illustrates a lateral cross-sectional view of a conventional inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
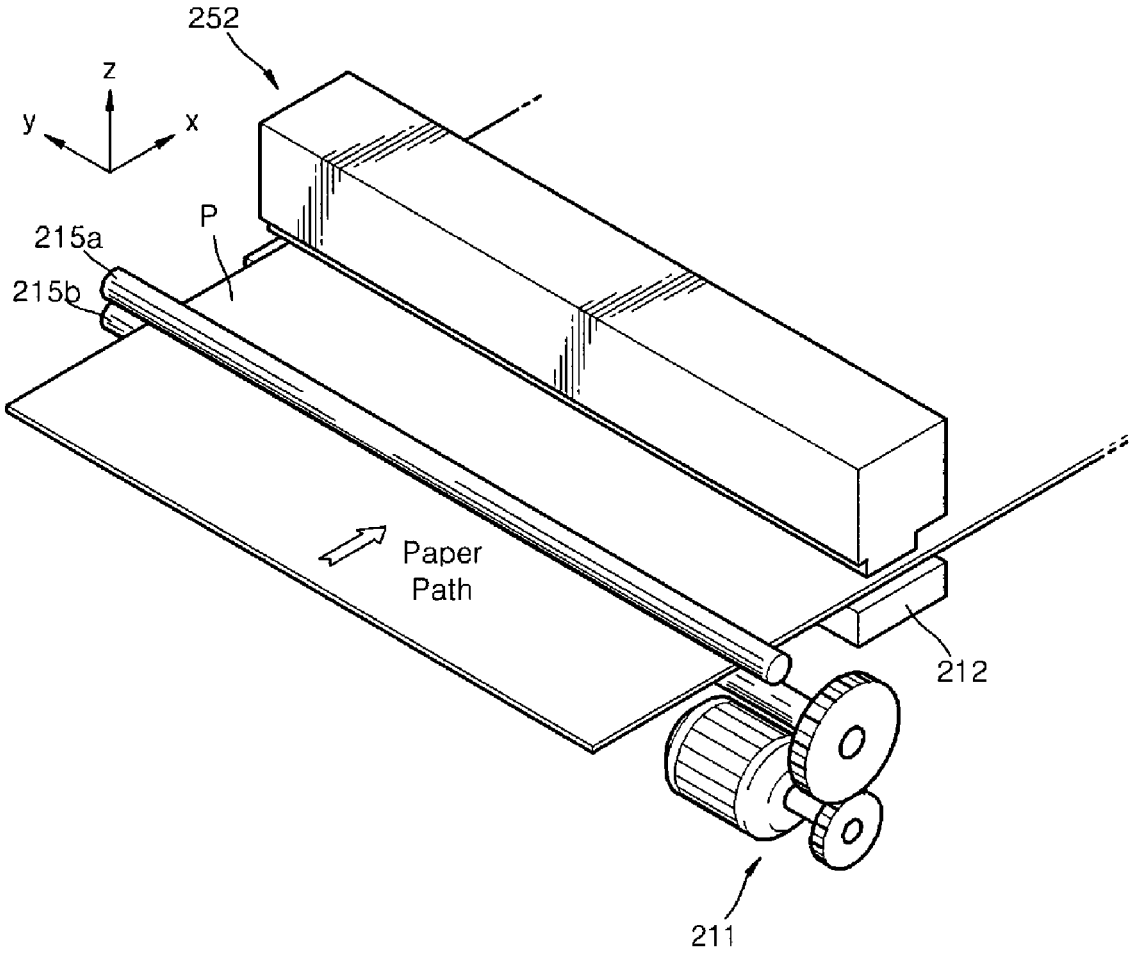
FIG. 2 is a perspective view illustrating main parts of an inkjet image forming apparatus according to an embodiment of the present general inventive concept.

FIG. 2 is a perspective view illustrating main parts of an inkjet image forming apparatus according to an embodiment of the present general inventive concept. In FIG. 2, a line printing type inkjet image forming apparatus that can print an image in a line unit by arranging nozzles 132 (see FIG. 4) at least as wide as a width of a printing medium P is illustrated. The printing medium P is transported in a length direction of the printing medium P, that is, an x direction (hereinafter a secondary ejection direction) and a y direction (hereinafter a primary ejection direction) is a width direction of the printing medium P.

The inkjet image forming apparatus may include an array type inkjet print head cartridge 252 which is fixed in the inkjet image forming apparatus and includes a plurality of inkjet printheads 260 (see FIG. 4), a platen 212 that provides a predetermined gap between the inkjet printhead 260 and the printing medium P and guides the printing medium P, feed rollers 215*a* and 215*b* that transport the printing medium P toward the inkjet print head cartridge, and a driving element 211 that drives the feed rollers 215*a* and 215*b*. While the inkjet head cartridge illustrated in FIG. 2 includes an array type inkjet head cartridge, the present general inventive concept is not limited thereto, and the image forming apparatus may also include a shuttle type inkjet image forming apparatus having a plurality of inkjet printheads 260.

Figure 3:
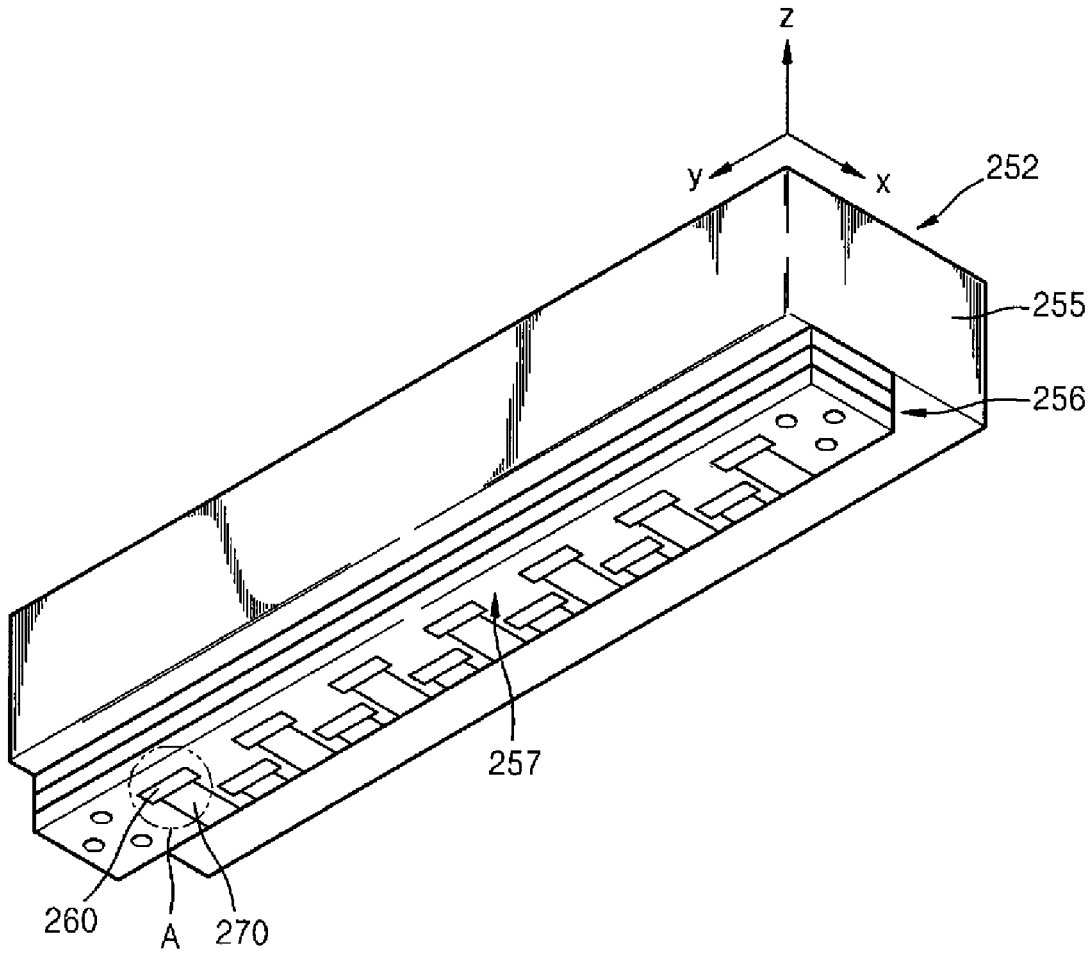
FIG. 3 is a perspective view illustrating an inkjet printhead cartridge of FIG. 2, according to an embodiment of the present general inventive concept.
Figure 4:
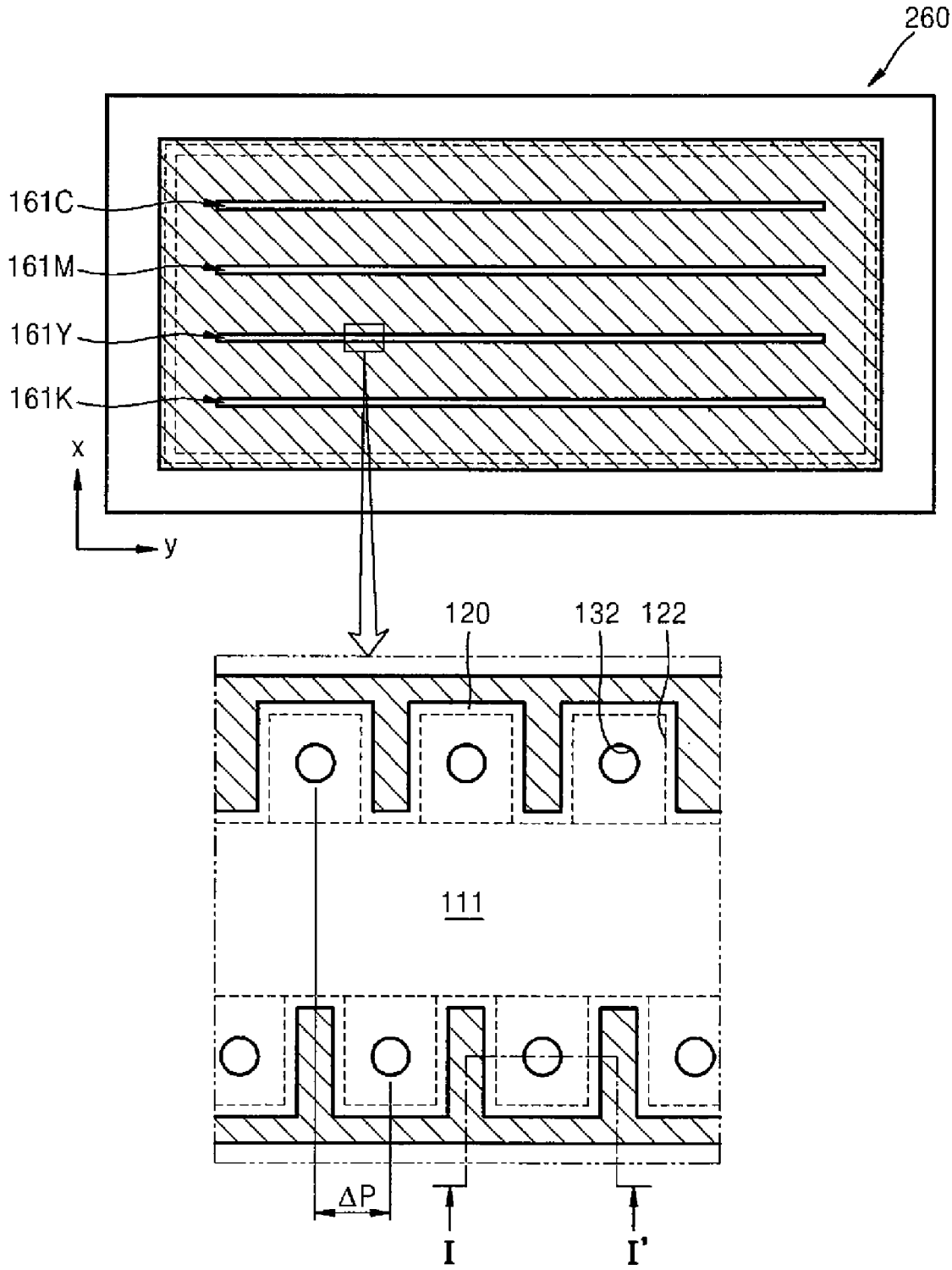
FIG. 4 is a plan view illustrating a portion A of the inkjet printhead of FIG. 3, according to an embodiment of the present general inventive concept.
Figure 5:
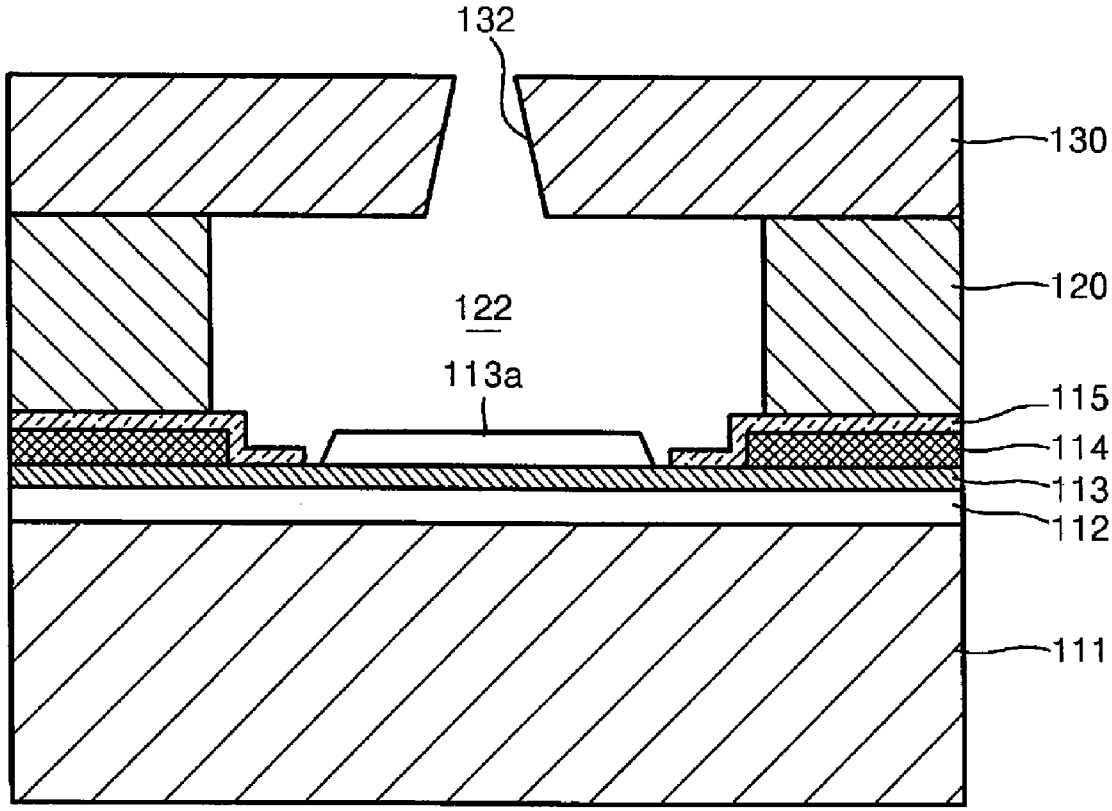
FIG. 5 is a lateral cross-sectional view taken along a line I-I' of FIG. 4, illustrating a vertical structure of an inkjet printhead according to an embodiment of the present general inventive concept.

FIG. 3 is a perspective view illustrating the array type inkjet printhead cartridge 252 of FIG. 2, according to an embodiment of the present general inventive concept. FIG. 4 is a plan view illustrating a portion A of the inkjet printhead 260 of FIG. 3, according to an embodiment of the present general inventive concept. FIG. 5 is a lateral cross-sectional view taken along a line I-I' of FIG. 4, illustrating a vertical structure of the inkjet printhead 260 according to an embodiment of the present general inventive concept.

Referring to FIG. 3, the array type inkjet printhead cartridge 252 may include a main body 255 having ink tanks (not illustrated) in which inks of different color are stored, a nozzle part 257 in which one or multiple inkjet printheads 260 are disposed along the width direction of the printing medium P, and an ink channel unit 256 that supplies ink stored in the ink tanks to the inkjet printheads 260. The length of the nozzle part 257 in a primary ejection direction corresponds to at least the width of the printing medium P, and data is simultaneously printed in the primary ejection direction.

For example, in order to print a color image, four kinds of nozzle rows 161C, 161M, 161Y, and 161K may be provided in each of the inkjet printheads 260 so that cyan (C), magenta (M), yellow (Y), and black (K) colored ink can be respectively ejected. The inkjet printheads 260 that can print a color image may include a plurality of ink tanks (not illustrated) that respectively store cyan, magenta, yellow, or black colored ink in the main body 255. The ink channel unit 256 forms an ink path from the ink tanks to rear surfaces of the inkjet printheads 260. The ink channel unit 256 can be formed, for example, by injection molding a liquid crystal polymer (LCP) to ensure thermal stability, durability, and productivity. The inkjet printheads 260 are connected to a control unit (not illustrated) of the inkjet image forming apparatus through flexible printed circuits 270 to receive driving signals and power to eject the ink.

The inkjet printheads 260 are separated a predetermined distance from each other in the primary and secondary ejection directions and may be disposed in a zigzag pattern. Although it is not illustrated, one or multiple inkjet printheads 260 can be arranged in a straight line pattern along the y-axis of the nozzle part 257 to a length corresponding to at least the width of the printing medium P. That is, the inkjet printheads 260 according to an embodiment of the present general inventive concept are not affected by the form of the arrangement pattern, and can be mounted to any type of inkjet image forming apparatus including a shuttle type inkjet image forming apparatus and an array type inkjet image forming apparatus.

As illustrated in FIG. 3, when the inkjet printheads 260 are arranged in a zigzag pattern, the control unit detects a deviation of each of the inkjet printheads 260 in an x-axis direction and a transporting amount of the printing medium P in the y-axis direction. Then, the control unit synchronizes the position of ink ejection of each of the nozzle rows 161C, 161M, 161Y, and 161K located on each of the inkjet printheads 260 in the x-axis direction. For example, the nozzle rows 161K of black color formed on different inkjet printheads 260 are located on the same straight line, but ink dots printed on the printing medium P can be formed on a straight line parallel to the y-axis by synchronizing the ink ejection position in the x-axis direction based on the deviation of the inkjet printheads 260 in the x-axis direction and the transporting amount of the printing medium P.

As illustrated in FIG. 4, a nozzle pitch ΔP, which is a distance between adjacent nozzles 132, determines the resolution of the inkjet image forming apparatus. For example, if the nozzle pitch ΔP is 1/600 inch, the resolution of the inkjet image forming apparatus is 600 dpi (dots per inch).

A vertical structure of each of the inkjet printheads 260 will now be described with reference to FIGS. 4 and 5. Each of the inkjet printheads 260 according to an embodiment of the present general inventive concept may include a substrate 111 on which a heater 113 and an electrode 114 are formed, a chamber layer 120 which is stacked on an upper part of the substrate 111 and includes an ink chamber 122 formed therein, and a nozzle layer 130 which is stacked on an upper part of the chamber layer 120 and has a nozzle 132 formed therein.

An insulating layer 112 may be formed on an upper surface of the substrate 111 to thermally and electrically insulate the heater 113 from the substrate 111. The insulating layer 112 can be formed of silicon oxide.

The heater 113 may be formed on an upper surface of the insulating layer 112 in a predetermined form to generate bubbles in the ink by heating the ink in the ink chamber 122. In the present embodiment, a heat generation part of the heater 113*a* is formed to directly contact the ink in the ink chamber 122. The heater 113 is formed of an alloy of Platinum and Ruthenium (Pt—Ru) or an alloy of Platinum, Iridium, and X (Pt—Ir—X) (wherein X is one of Tantalum (Ta), Tungsten (W), Chromium (Cr), Aluminium (Al), and Oxygen (O)). The heater 113 can be formed by patterning a thin film of Pt—Ru alloy or a Pt—Ir—X alloy deposited on the insulating layer 112 by sputtering. According to the present embodiment of the present general inventive concept, the heater 113 can be formed to a thickness of 500 to 3000 Å. In the present embodiment, an input energy applied to the heater 113 through the electrode 114 which will be described later may be 1.0 μJ or less. The heater 113 may have a lifespan of one hundred million pulses or more.

The electrode 114, which is electrically connected to the heater 113 to apply a current to the heater 113, is formed on upper side surfaces of the heater 113. The electrode 114 can be formed of a metal having high electric conductivity, such as aluminum. The electrode 114 can be formed on the heater 113 so that a heat generation part of the heater 113*a*, that is, an area of the heater 113 exposed to the ink chamber 122 between the upper side surfaces of the heater 113 on which the electrode 114 is formed, can be approximately 650 $\mu m^2$ or less. A passivation layer 115 covering the electrode 114 can be further formed on the substrate 111 to protect the electrode 114 from being corroded by ink. The passivation layer 115 may be formed of a silicon nitride $SiN_x$.

The chamber layer 120 in which the ink chamber 122 to store the ink to be ejected is stacked above the substrate 111 on which the heater 113, the electrode 114, and the passivation layer 115 may be formed. The chamber layer 120 can be formed of a polymer. The ink chamber 122 is located above the heat generation part 113*a*. Accordingly, the heat generation part 113*a* is located on a bottom surface of the ink chamber 122, and directly contacts the ink in the ink chamber 122.

The nozzle layer 130 having the nozzle 132 through which ink in the ink chamber 122 is ejected is stacked on an upper part of the chamber layer 120. The nozzle layer 130 can be formed of a polymer. The nozzle 132 can be disposed at a position corresponding to the center of the ink chamber 122. While in the present embodiment the heater 113 is applied to a top-shooting type inkjet printhead 260, the present general inventive concept is not limited thereto, and the heater 113 according to an embodiment of the present general inventive concept can be applied to any type of inkjet printhead, such as a side-shooting type inkjet printhead or a back-shooting type inkjet printhead.

As described above, the inkjet printhead 260 according to the current embodiment of the present general inventive concept has a structure in which the heat generation part 113*a* directly contacts the ink in the ink chamber 122. In this case, a material to form the heater 113 must have electrical, chemical, and mechanical stability with respect to the ink. More specifically, the resistance of the heater 113 must not be rapidly changed by oxidation, the heater 113 must not be corroded by ink, and the heater 113 must resist a cavitation force generated when the bubbles disappears.

According to the present general inventive concept, various tests and simulations show that a material selected from a noble metal group having high electrical, chemical, and mechanical stability with respect to ink is an alloy of Pt—Ru or an alloy of Pt—Ir—X. Here, X may be at least one material selected from the group consisting of Ta, W, Cr, Al, and O. The Pt—Ru thin film or the Pt—Ir—X thin film may be formed by a co-sputtering process in which more than two materials are deposited together on the substrate 111 placed in a deposition chamber.

An adhesiveness between the insulating layer 112 formed of silicon oxide $SiO_2$ and the heater 113 can be a problem. Therefore, according to an embodiment of the present general inventive concept, the inkjet printhead 260 can further include an adhesive layer between the insulating layer 112 and the heater 113 to increase the adhesiveness between the insulating layer 112 and the heater 113. As an example, the adhesive layer can be formed of Ta, and the adhesiveness may be increased by depositing a Ta layer having a thickness of 10 nm on the substrate 111 and the insulating layer 112 prior to forming the heater 113.

Figure 6:
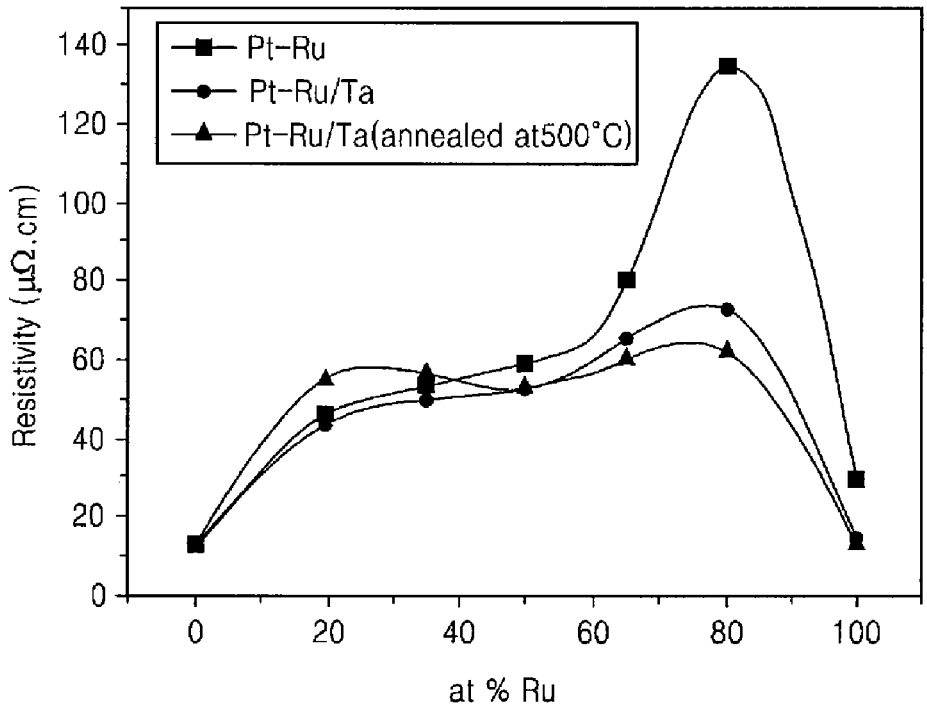
FIG. 6 is a graph illustrating the resistivity of a heater formed of an alloy of Pt—Ru according to the composition percentage of Ru in the heater, according to an embodiment of the present general inventive concept.

FIG. 6 is a graph illustrating the resistivity of the heater 113 according to the composition percentage of Ru when the heater 113 is formed of an alloy of Pt—Ru, according to an embodiment of the present general inventive concept. In FIG. 6, the resistivity of the heater 113 formed of the alloy of Pt—Ru deposited on the insulating layer 112 is indicated by a symbol '■', the resistivity of the heater 113 formed of the alloy of Pt—Ru and deposited on an adhesive layer formed of Ta is indicated by a symbol '•', and the resistivity of the heater 113 formed of the alloy of Pt—Ru and annealed at a temperature of 500° C. after being deposited on the adhesive layer formed of Ta is indicated by a symbol '▲'.

The heater 113 is required to have a high resistivity so that a large amount of heat can be generated even with a small amount of energy input. Also, to control the heater 113 at a uniform temperature despite a component change or a high frequency driving of the heater 113, it is required that the resistivity of the heater 113 remain uniform even though the composition percentage of Ru may change in a deposition process. Referring to FIG. 6, when the composition percentage of Ru ranges from about 20% to about 80%, the heater 113 has a high resistivity. Also, in the above composition percentage range, the resistivity of the heater 113 according to the composition percentage of Ru remains relatively uniform.

Figure 7:
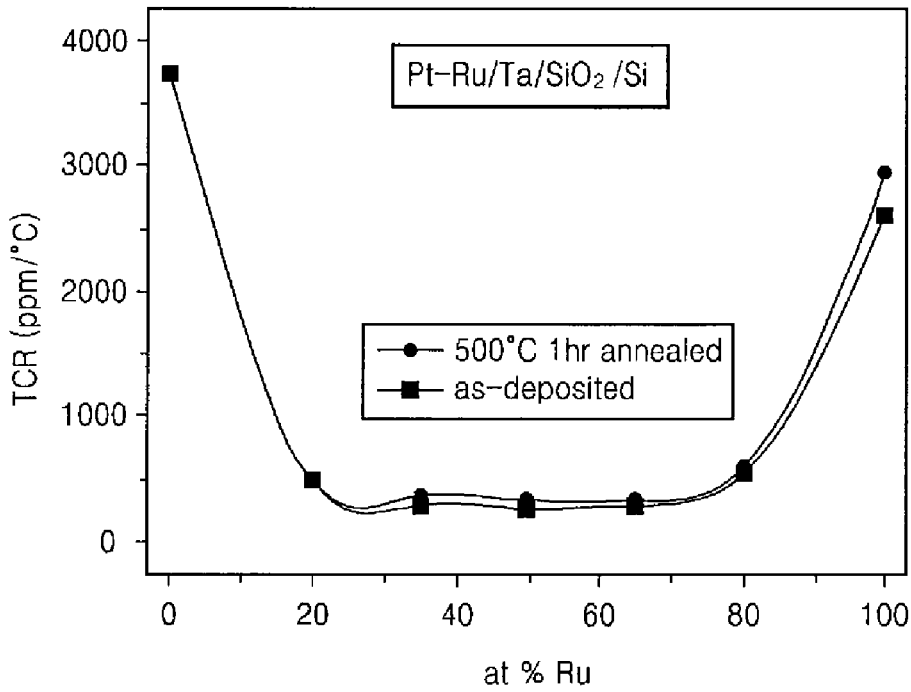
FIG. 7 is a graph illustrating the temperature coefficient of resistance (TCR) of a heater formed of an alloy of Pt—Ru according to the composition percentage of Ru in the heater, according to an embodiment of the present general inventive concept.

FIG. 7 is a graph illustrating the temperature coefficient of resistance (TCR) of the heater 113 according to the composition percentage of Ru when the heater 113 is formed of an alloy of Pt—Ru, according to an embodiment of the present general inventive concept. In FIG. 7, the TCR of the heater 113 formed of the alloy of Pt—Ru deposited on the substrate 111 formed of silicon, the insulating layer 112 formed of silicon oxide, and the adhesive layer formed of Ta to a thickness of 10 nm is indicated by a symbol '■', and the TCR of the heater 113 formed of the alloy of Pt—Ru and annealed at a temperature of 500° C. after the heater 113 is deposited on the substrate 111 formed of silicon, the insulating layer 112 formed of silicon oxide, and the adhesive layer formed of Ta to a thickness of 10 nm is indicated by a symbol '•'.

For convenience of explanation and calculation, it is assumed that the TCR is 1000 PPM/° C. and the resistance of the heater 113 at 0° C. is 1 kΩ. In this case, the resistance of the heater 113 at 0° C. is 1.001 kΩ and at 500° C. is 1.5 kΩ. Accordingly, the heater 113 is required to have a low TCR due to the characteristics of the heater 113 that is repeatedly heated to 500° C. and cooled. Also, to control the heater 113 at a uniform temperature despite a component change or the high frequency driving of the heater 113, it is required that the TCR of the heater 113 remain uniform even though the composition percentage of Ru may change in the deposition process.

Referring to FIG. 7, when the composition percentage of Ru changes in a range of about 20% to about 80%, the heater 113 has a relatively low TCR. Also, in the above composition percentage range, the TCR of the heater 113 according to the composition percentage of Ru remains relatively uniform. That is, from the test results illustrated in FIGS. 6 and 7, according to an embodiment of the present general inventive concept, the heater 113 may be formed of an alloy of Pt—Ru and the composition of Ru may be about 20% to about 80%.

From the above test results, electrical, chemical, and mechanical characteristics of the heater 113 formed of an alloy of Pt—Ru are evaluated as follows.

First, a reactivity test of the heater 113 with ink was performed. A shape of the heater 113 was observed after the heater 113 was driven for eight weeks using ten kinds of inks at a temperature of 60° C. However, no reaction between the heater 113 and the ink was observed and a delamination of the heater 113 did not occur.

The resistance of the heater 113 can vary in an inkjet printhead manufacturing process. More specifically, in a process of forming the electrode 114 using Al after the heater 113 is deposited, the heater 113 can be exposed to an etchant in a process of etching the Al, and in a process of removing a photoresist in a patterning process of the heater 113, the heater 113 can be exposed to oxygen plasma.

The sheet resistance of the heater 113 measured right after the heater 113 was deposited was 7.56 kΩ/□, the sheet resistance measured after the process of etching Al was 7.56 kΩ/□, and the sheet resistance measured after the process of removing the photoresist was 5.57 kΩ/□. That is, the heater 113 formed of an alloy of Pt—Ru showed almost no resistance change with respect to the atmospheric conditions in which the inkjet printhead 260 was manufactured.

The heater 113 must also have an electrical strength of approximately 1.5 $GW/m^2$ or more so that the heater 113 cannot be damaged when the heater 113 is repeatedly heated to generate bubbles in the ink. In the inkjet printhead 260 according to an embodiment of the present general inventive concept, when the heat generation part 113*a* of the heater 113 formed of an alloy of Pt—Ru is formed to have an area of 22 μm×29 μm, that is 638 $\mu m^2$, the heater 113 has an electrical strength of approximately 3 $GW/m^2$ in an air atmosphere. That is, since the heater 113 formed of an alloy of Pt—Ru has an electrical strength twice that of the required electrical strength, the heater 113 according to an embodiment of the present general inventive concept has a sufficient electrical strength margin, and thus, has a high electrical stability.

Also, in the inkjet printhead 260 according to an embodiment of the present general inventive concept, since the heater 113 is directly exposed to ink, the heater 113 must have a sufficient mechanical strength with respect to a cavitation force generated when the bubbles disappear. Also, since the heater 113 directly contacts ink, there must be no electrochemical reaction between the heater 113 and the ink. A bubble test of the heater 113 which is formed of an alloy of Pt—Ru and has a heat generation part area 113*a* of 22 μm×29 μm was carried out using a commercially available ink. As a result of the test, the energy required to be input to the heater 113 to form stable bubbles was approximately 0.51 μJ. This energy is much lower than the energy (1.2 μJ) input to a heater formed of Ta (with a heat generation part area of 22 μm×22 μm) of a conventional inkjet printhead in which a passivation layer formed of silicon nitride $SiN_x$ having a thickness of 6000 Å and an anti-cavitation layer having a thickness of 3000 Å were formed on the heater and also covered the heat generation part area. That is, since the heater 113 according to the present general inventive concept directly contacts the ink, the energy input to the heater 113 required to generate stable bubbles can be reduced to less than 50% of that of the conventional inkjet printhead.

Also, when the above energy is continuously applied to the heater 113 formed of an alloy of Pt—Ru, the heater 113 shows a lifespan of approximately one hundred million pulses or more. A lifespan of one hundred million pulses indicates that the heater 113 has a high mechanical, electrical, and chemical stability.

The characteristics of the heater 113 according to an embodiment of the present general inventive concept, when the heater 113 is formed of an alloy of Pt—Ir—X will now be described with reference to FIGS. 8 and 9. X may be at least one material selected from the group consisting of Ta, W, Cr, Al, and O.

Figure 8:
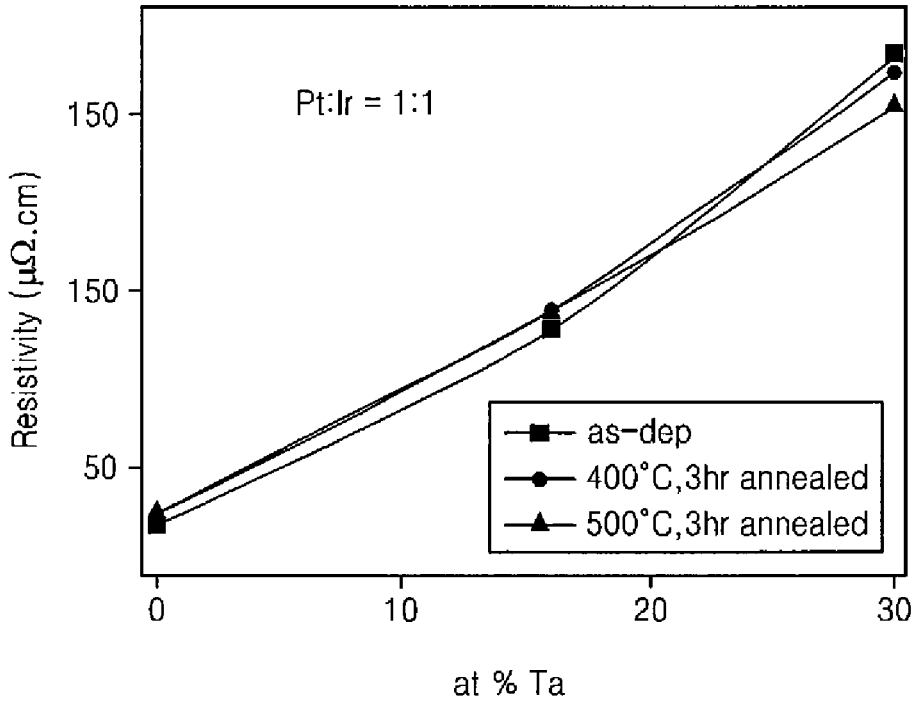
FIG. 8 is a graph illustrating the resistivity of a heater formed of an alloy of Pt—Ir—Ta according to the composition percentage of Ta in the heater, according to an embodiment of the present general inventive concept.
Figure 9:
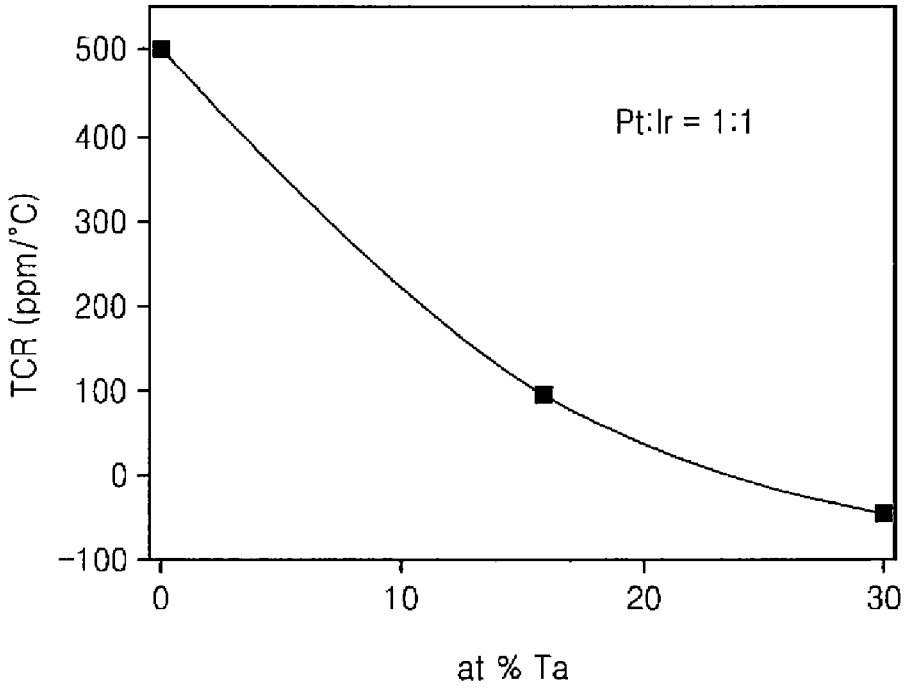
FIG. 9 is a graph illustrating the TCR of a heater formed of an alloy of Pt—Ir—Ta according to the composition percentage of Ta in the heater, according to an embodiment of the present general inventive concept.

FIG. 8 is a graph illustrating the resistivity of the heater 113 according to the composition percentage of Ta in the heater 113 when the heater 113 is formed of an alloy of Pt—Ir—X, in which the composition percentages of Pt and Ir are substantially equal and X is Ta, according to an embodiment of the present general inventive concept. In the present embodiment, for example, if the composition percentage of Ta is 10%, the composition ratio of Pt:Ir:Ta is 45:45:10, and if the composition percentage of Ta is 30%, the composition ratio of Pt:Ir:Ta is 35:35:30. While the present embodiment uses composition percentages of Pt and Ir that are substantially equal, the present general inventive concept is not limited thereto, and the composition percentages of PT and Ir may not be equal.

In FIG. 8, the resistivity of the heater 113 formed of an alloy of Pt—Ir—Ta after the heater 113 is deposited is indicated by a symbol '■', the resistivity of the heater 113 formed of the alloy of Pt—Ir—Ta after the heater 113 is annealed for 3 hours at a temperature of 400° C. is indicated by a symbol '•', and the resistivity of the heater 113 after the heater 113 formed of the alloy of Pt—Ir—Ta is annealed for 3 hours at a temperature of 500° C. is indicated by a symbol '▲'. FIG. 9 is a graph illustrating a TCR of the heater 113 according to the composition percentage of Ta in the heater 113 when the heater 113 is formed of the alloy of Pt—Ir—Ta.

As described above, the heater 113 of the inkjet printhead 260 is required to have a high resistivity and a low TCR. As the composition percentage of Ta increases in the heater 113, the resistivity increases but the TCR decreases. The resistivity of the heater 113 does not change in spite of annealing. These results show that an inkjet printhead that is repeatedly heated to 500° C. and cooled has a high thermal stability.

Accordingly, an example of an embodiment of the present general inventive concept is a heater 113 formed of an alloy of Pt—Ir—X, where Pt and Ir have substantially the same composition percentage, X is Ta, and Ta has a composition percentage of between about 0% to about 30% with respect to the total composition of the alloy of Pt, Ir, and Ta.

Figure 10:
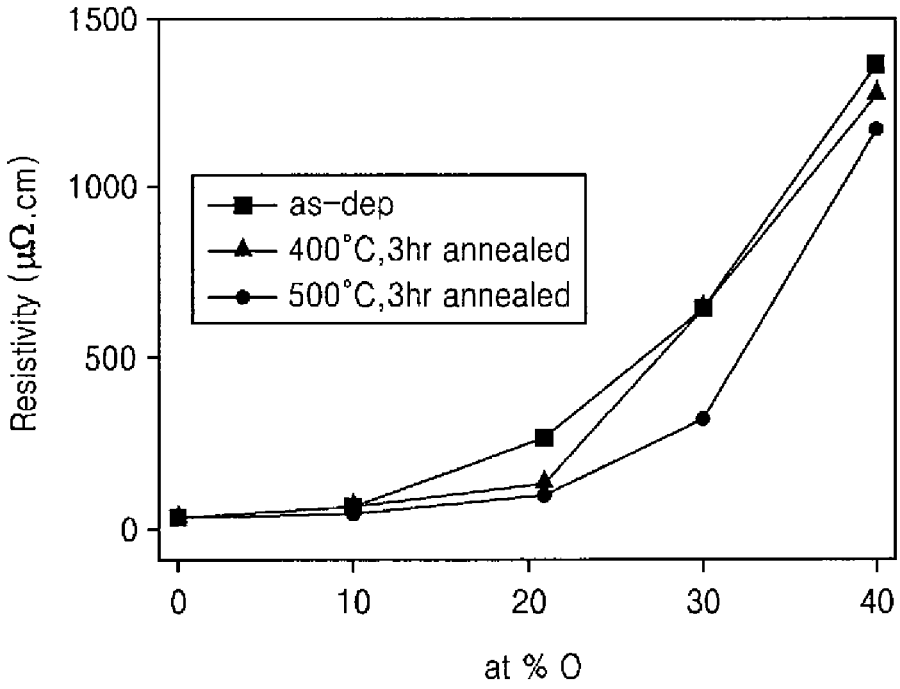
FIG. 10 is a graph illustrating the resistivity of a heater formed of an alloy of Pt—Ir—O according to the composition percentage of O in the heater, according to an embodiment of the present general inventive concept.

FIG. 10 is a graph illustrating the resistivity of the heater 113 according to a composition percentage of O in the heater 113 when the heater 113 is formed of an alloy of Pt—Ir—X and X is O, according to an embodiment of the present general inventive concept. In the present embodiment, Pt and Ir have substantially the same composition percentage and O has a composition percentage between about 0% to about 40% with respect to the total composition of the alloy of Pt, Ir, and O.

Figure 11:
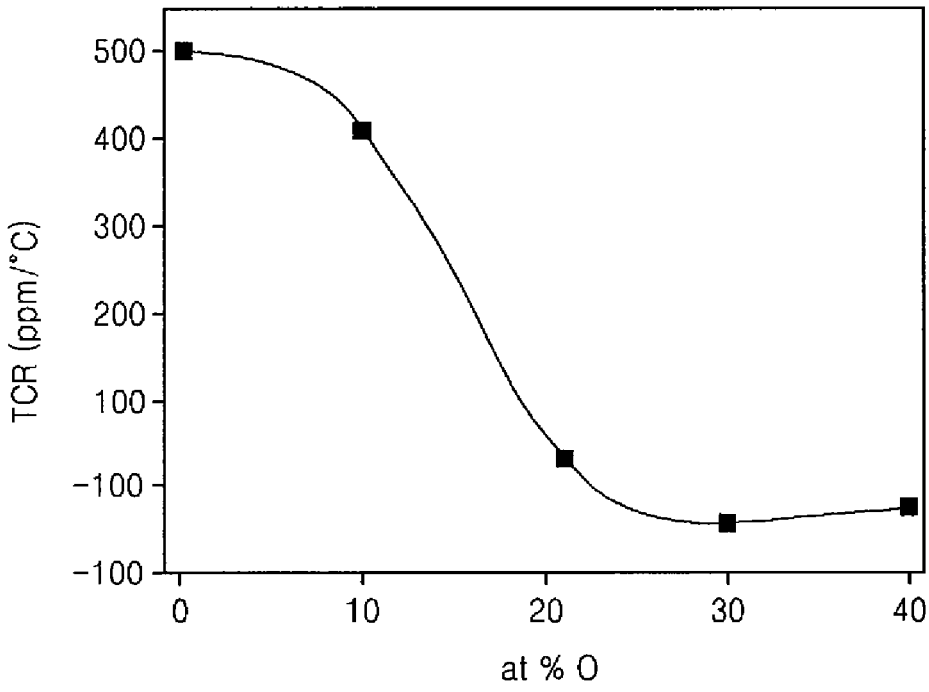
FIG. 11 is a graph illustrating the TCR of a heater formed of an alloy of Pt—Ir—O according to the composition percentage of O in the heater, according to an embodiment of the present general inventive concept.

In FIG. 10, the resistivity of the heater 113 formed of an alloy of Pt—Ir—O after the heater 113 is deposited is indicated by a symbol '■', the resistivity of the heater 113 formed of the alloy of Pt—Ir—O after the heater 113 is annealed for 3 hours at a temperature of 400° C. is indicated by a symbol '▲', and the resistivity of the heater 113 of the alloy of Pt—Ir—O after the heater 113 is annealed for 3 hours at a temperature of 500° C. is indicated by a symbol '•'. FIG. 11 is a graph illustrating the TCR of the heater 113 of the alloy of Pt—Ir—O according to the composition percentage of O in the heater 113 when the heater 113 is formed of the alloy of Pt—Ir—O, according to an embodiment of the present general inventive concept.

Referring to FIG. 10, when the composition percentage of O is about 20%, the resistivity of the heater 113 begins to change and increases until the composition percentage of O reaches about 40% while, referring to FIG. 11, the TCR decreases as the composition percentage of O approaches about 20%. Despite annealing, the variation of the resistivity is very small. These results show that an inkjet printhead that is repeatedly heated to 500° C. and cooled has a high thermal stability.

Sheet resistances, input energies, and life spans of two kinds of heaters 113, that is, heaters formed of an alloy of Pt—Ir—Ta and an alloy of Pt—Ir—O, having composition ratios of, for example, 35, 35, and 30 and 30, 30, and 40 respectively, were measured. The areas of the heat generation parts 113*a* and the thicknesses of the heaters 113 for these two heaters after patterning were 22 μm×29 μm (638 $\mu m^2$) and 1000 Å, respectively.

A sheet resistance of 18.74 Ω/□, an input energy of 0.61 μJ, an electrical strength of 2.61 $GW/m^2$, and a life span of $2.0\times10^8$ were measured with respect to the heater 113 formed of $Pt_{0.35}$—$Ir_{0.35}$—$Ta_{0.30}$, and no abnormality was observed in the heater 113. A sheet resistance of 24.14 Ω/□, an input energy of 0.70 μJ, an electrical strength of 3.20 $GW/m^2$, and a life span of $2.3\times10^7$ were measured with respect to the heater 113 formed of $Pt_{0.30}$—$Ir_{0.30}$—$O_{0.40}$, and no abnormality was observed in the heater 113.

If a heater 113 has a heat generation part area of 22 μm×29 μm (638 $\mu m^2$) and a thickness of 1000 Å, the heater 113 must have an electrical strength of approximately 1.5 $GW/m^2$ or more so that the heater 113 cannot be damaged when bubbles are formed in the ink by the heater 113. Since the heater 113 formed of an alloy of Pt—Ir—X has the electrical strength twice that of the required electrical strength, the heater 113 according to the current embodiment of the present general inventive concept has a sufficient electrical strength margin, and thus, has high electrical stability.

From the test results, energies inputted to the heaters 113 formed of $Pt_{0.35}$—$Ir_{0.35}$—$Ta_{0.30}$ and $Pt_{0.30}$—$Ir_{0.30}$—$O_{0.40}$ respectively to generate stable bubbles in the ink were 0.61 μJ and 0.7 μJ respectively. This level of energy input to the heaters 113 is very small when compared to the energy (1.2 μJ) inputted to a heater formed of TaN (having a heat generation part area of 22 μm×22 μm) of a conventional inkjet printhead in which a passivation layer formed of silicon nitride $SiN_x$ having a thickness of 6000 Å and an anti-cavitation layer having a thickness of 3000 Å were formed on the heater 113. That is, since the heaters 113 according to the present general inventive concept formed of Pt—Ir—Ta or Pt—Ir—O directly contact the ink, the energy input to the heaters 113 required to generate stable bubbles can be reduced to less than 50% of that of the conventional inkjet printhead.

Also, when the above energy is continuously applied to the heater 113 formed of an alloy of Pt—Ir—X, the heater 113 shows a lifespan of approximately a few tens of millions to a few hundreds of millions of pulses or more. The long lifespan of the heater 113 indicates that the heater 113 has high mechanical, electrical, and chemical stability.

While in the paragraphs above, heaters formed of an alloy of Pt—Ir—X where X is either Ta or O have been described, X can be one of a group of Ta, W, Cr, Al, and O, for which similar sheet resistance, input energy of 0.61, electrical strength, and mechanical, electrical, and chemical stability cab be expected when X is also W, Cr, and Al.

As described above, an inkjet printhead according to the present general inventive concept and an inkjet image forming apparatus including the inkjet printhead can reduce energy input to a heater required to eject ink, can increase the mechanical, electrical, and chemical stability of the heater, can reduce power required to instantaneously eject ink, can prevent the degradation of characteristics of ink due to accumulation of heat and can increase integration density of nozzles. In particular, the inkjet printhead according to an embodiment of the present general inventive concept is suitable as both an array type printing inkjet printhead and a line type printing inkjet printhead that have problems of power capacity due to high-speed printing using several tens of thousands of nozzles and of heat accumulation.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead comprising:

a substrate;

a heater formed on the substrate;

an electrode formed on the heater to apply a current to the heater;

a chamber layer which is stacked on an upper part of the substrate on which the heater and the electrode are formed and comprises an ink chamber which stores an ink to be ejected and is formed above a heat generation part of the heater; and a nozzle layer which is stacked on an upper part of the chamber layer and comprises a plurality of nozzles through which the ink is ejected, wherein the heat generation part directly contacts the ink in the ink chamber and the heater is formed of one of an alloy of Pt—Ru, where the composition percentage of Ru is about 20% to about 80%, and an alloy of Pt—Ir, where Pt and Ir have the same composition percentage, and a material X.

2. The inkjet printhead of claim 1, wherein the heater has a thickness of about 500 to 3000 Å.

3. The inkjet printhead of claim 1, wherein the area of the heat generation part of the heater is about 650 $\mu m^2$ or less.

4. The inkjet printhead of claim 1, wherein an input energy applied to the heater is about 1.0 μJ or less.

5. The inkjet printhead of claim 1, wherein the heater has a lifespan of about one hundred million pulses or more.

6. The inkjet printhead of claim 1, further comprising: an insulating layer between the substrate and the heater to thermally and electrically insulate the heater from the substrate.

7. The inkjet printhead of claim 6, wherein the insulating layer is formed of silicon oxide ($SiO_2$).

8. The inkjet printhead of claim 7, further comprising: an adhesive layer between the insulating layer and the heater to increase an adhesiveness between the insulating layer and the heater.

9. The inkjet printhead of claim 8, wherein the adhesive layer is formed of Ta.

10. The inkjet printhead of claim 1, further comprising: a passivation layer covering the electrode to prevent contact between the electrode and the ink.

11. The inkjet printhead of claim 10, wherein the passivation layer is formed of a silicon nitride ($SiN_X$)

12. The inkjet printhead of claim 1, wherein the electrode is formed on upper side surfaces of the heater.

13. The inkjet printhead of claim 1, wherein the material X is an impurity.

14. The inkjet printhead of claim 13, wherein the impurity X may be at least one material selected from the group consisting of Ta, W, Cr, Al, and O.

15. The inkjet printhead of claim 14, wherein the impurity X that constitutes the heater is Ta, and the composition percentage of Ta with respect to the sum of compositions of Pt, Ir, and Ta is greater than about 0% and smaller than about 30%.

16. The inkjet printhead of claim 14, wherein the impurity X in the alloy of Pt, Ir and the impurity X constituting the heater is O, and the composition percentage of O with respect to the sum of compositions of Pt, Ir, and O is greater than about 0% and smaller than about 40%.

17. An inkjet image forming apparatus comprising:

thermal inkjet printheads that eject ink through a plurality of nozzles by heating a heater, wherein the heater contacts the ink and is formed of one of an alloy of Pt—Ru, where the composition percentage of Ru is about 20% to about 80%, and an alloy of Pt—Ir, where Pt and r have about the same composition percentage, and an impurity X.

18. The inkjet image forming apparatus of claim 17, wherein each of the thermal inkjet printheads comprises a passivation layer covering an electrode to prevent contact between the electrode and the ink.

19. The inkjet image forming apparatus of claim 17, wherein the nozzles are disposed in a length corresponding to at least a width of a printing medium.

20. The inkjet image forming apparatus of claim 17, wherein the impurity X is at least a material selected from the group consisting of Ta, W, Cr, Al, and O.

21. An inkjet image forming apparatus comprising: a plurality of thermal inkjet printheads that eject ink through a plurality of nozzles by applying a heat to the ink with a plurality of heaters, wherein the heater directly contacts the ink and is formed of one of an alloy of Pt—Ru, where the composition percentage of Ru is about 20% to 80%. and an alloy of Pt—Ir, where Pt and Ir have about the same composition percentage, and an impurity X.

22. The inkjet image forming apparatus of claim 21, wherein the impurity X is Ta, the heater is made of an alloy of Pt, Ir, and Ta, and the composition percentage of Ta with respect to the sum of compositions of Pt, Ir, and Ta is greater than about 0% and smaller than about 30%.

23. The inkjet image forming apparatus of claim 21, wherein the impurity X is O, the heater is made of an alloy of Pt, Ir, and O, and the composition percentage of O with respect to the sum of compositions of Pt, Ir, and O is greater than about 0% and smaller than about 40%.

24. The inkjet image forming apparatus of claim 21, wherein the heater is made of an alloy of Pt, Ir, and the impurity X, and the impurity X is a material selected from the group consisting of Ta, W, Cr, Al, and O, or a combination thereof.

25. A thermal inkjet printhead, comprising:

a substrate;

a heater formed above the substrate and including an alloy of one of Pt—Ru, where the composition percentage of Ru is about 20% to about 80%, and Pt—lr, where Pt and Ir have about the same composition percentage, and an impurity X;

an electrode formed above portions of the heater to expose a heat generating portion of the heater; and an ink chamber, formed above the electrode and the heater to contain ink therein such that the contained ink contacts the heat generating portion of the heater.

26. The thermal inkjet printhead of claim 25, wherein the heater is made of an alloy of Pt, Ir, and the impurity X, and the impurity X is a material selected from the group consisting of Ta, W, Cr, Al, and O, or a combination thereof.

27. A heating element usable in an inkjet printhead, the heating element comprising an alloy of one of Pt—Ru, where the composition percentage of Ru is about 20% to about 80%, and Pt—Ir, where Pt and k have about the same composition percentage, and an impurity X.

28. The heating element of claim 27, wherein the alloy is Pt, Ir, and the impurity X, and the impurity X is a material selected from the group consisting of Ta, W, Cr, Al, and O, or a combination thereof.

* * * * *